US008623805B2

(12) United States Patent
Schacht et al.

(10) Patent No.: US 8,623,805 B2
(45) **Date of Patent: *Jan. 7, 2014**

(54) ACID CLEANING AND CORROSION INHIBITING COMPOSITIONS COMPRISING A BLEND OF NITRIC AND SULFURIC ACID

(75) Inventors: Paul F. Schacht, Oakdale, MN (US); Eric V. Schmidt, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/344,141

(22) Filed: Jan. 5, 2012

(65) Prior Publication Data

US 2012/0172276 A1 Jul. 5, 2012

Related U.S. Application Data

(63) Continuation-in-part of application No. 12/984,680, filed on Jan. 5, 2011, now abandoned.

(51) Int. Cl.
*C11D 17/00* (2006.01)

(52) U.S. Cl.
USPC ..... 510/218; 134/18

(58) Field of Classification Search
None
See application file for complete search history.

(56) References Cited

U.S. PATENT DOCUMENTS

| | | | |
|---|---|---|---|
| 3,668,137 | A | 6/1972 | Gardner |
| 3,752,169 | A | 8/1973 | Rauch, Jr. |
| 3,887,488 | A | 6/1975 | Scott |
| 4,154,791 | A | 5/1979 | Howells |
| 4,356,148 | A | 10/1982 | Kagawa |
| 4,539,140 | A | 9/1985 | Quinlan |
| 6,200,947 | B1 | 3/2001 | Takashima |
| 6,218,349 | B1 | 4/2001 | Kravitz et al. |
| 6,540,943 | B1 | 4/2003 | Treybig et al. |
| 6,617,290 | B2 | 9/2003 | Lopes |
| 6,953,772 | B2 | 10/2005 | Lopes |
| 7,494,963 | B2 | 2/2009 | Ahmed et al. |
| 7,501,027 | B2 | 3/2009 | Ahmed et al. |
| 2002/0039981 | A1 | 4/2002 | Lopes |
| 2003/0235623 | A1 | 12/2003 | Van Oosterom |
| 2004/0074873 | A1 | 4/2004 | Kool et al. |
| 2006/0035808 | A1 | 2/2006 | Ahmed et al. |
| 2006/0046945 | A1 | 3/2006 | Herdt et al. |
| 2006/0280810 | A1 | 12/2006 | Kross |
| 2008/0015134 | A1 | 1/2008 | Ahmed et al. |
| 2008/0319070 | A1 | 12/2008 | Kany |
| 2009/0050179 | A1 | 2/2009 | Kang et al. |

FOREIGN PATENT DOCUMENTS

| | | | |
|---|---|---|---|
| EP | 1311653 | B1 | 5/2004 |
| EP | 1561801 | A1 | 8/2005 |
| EP | 1263918 | | 11/2005 |

(Continued)

OTHER PUBLICATIONS

LaQue, F.L. and Copson, H.R., "Corrosion Resistance of Metals and Alloys", Second Edition, American Chemical Society Monograph Series, Reinhold Publishing Corporation, New York, p. 393-395.

*Primary Examiner* — Necholus Ogden, Jr.
(74) *Attorney, Agent, or Firm* — Andrew D. Sorensen; Shaoni L. Mitchell

(57) ABSTRACT

The present invention relates to aqueous, sulfuric acid cleaners which employ the use of nitric acid as a corrosion inhibitor for cleaning metal and other surfaces, particularly stainless steel and for inhibiting corrosion. Method of use and manufacturing of the same are also disclosed.

22 Claims, 3 Drawing Sheets

(56) References Cited

FOREIGN PATENT DOCUMENTS

| | | | |
|---|---|---|---|
| EP | 1693437 | A1 | 8/2006 |
| EP | 1693437 | A4 | 12/2007 |
| EP | 1709145 | B1 | 6/2009 |
| GB | 917432 | | 2/1963 |
| KR | 10-0305693 | | 10/2001 |
| KR | 10-0328057 | | 5/2002 |
| KR | 10-0696928 | | 3/2007 |
| WO | WO01/70921 | A2 | 9/2001 |
| WO | WO01/70921 | A3 | 12/2001 |
| WO | WO02/10325 | A1 | 2/2002 |
| WO | WO02/10325 | A8 | 4/2002 |
| WO | WO2005/073359 | | 8/2005 |
| WO | WO2006/020608 | A2 | 2/2006 |
| WO | WO2006/020608 | A3 | 10/2006 |
| WO | WO2007/050291 | | 5/2007 |
| WO | WO2007/128345 | | 11/2007 |
| WO | WO2008/022650 | | 2/2008 |
| WO | WO2009/059630 | * | 5/2009 |

* cited by examiner

ACID CLEANING AND CORROSION INHIBITING COMPOSITIONS COMPRISING A BLEND OF NITRIC AND SULFURIC ACID

CROSS-REFERENCE TO RELATED APPLICATIONS

This application claims priority and is related to U.S. application Ser. No. 12/984,680 filed on Jan. 5, 2011 and entitled "Acid Cleaning and Corrosion Inhibiting Compositions Comprising a Blend of Nitric and Sulfuric Acid." The entire contents of this patent application are hereby expressly incorporated herein by reference including, without limitation, the specification, claims, and abstract, as well as any figures, tables, or drawings thereof.

FIELD OF THE INVENTION

The present invention relates to aqueous acid cleaners for cleaning metal and other surfaces, particularly stainless steel while minimizing corrosion. Methods of use and manufacturing of the same are also disclosed.

BACKGROUND

Steel is the generic name for a group of ferrous metals, composed principally of iron, which have considerable durability and versatility. By the proper choice of carbon content, addition of alloying elements, and by suitable heat treatment, different kinds of steel can be made for various purposes and the use in industry of all kinds of steel is now quite expansive.

Stainless steel (SS) is defined as a steel alloy, with a minimum of 11% chromium content by mass. Stainless steel does not stain, corrode, or rust as easily as traditional steel. There are over 150 different grades and surface finishes to allow the stainless steel to suit the environment in which it will be used. Stainless steel's low maintenance and relatively low cost make it an ideal base material for many commercial applications. It is used in cookware, cutlery, hardware, surgical instruments, major appliances, industrial equipment, food and beverage processing industry equipment. It is also used as a structural alloy for cars and as a construction material for buildings.

Stainless steels have a passive film of chromium oxide that forms in the presence of oxygen due to the chromium present in the steel. This layer blocks most corrosion from spreading into the metal's internal structure. High corrosion resistance can be achieved with chromium additions of 13% by weight up to 26% for harsh environments. The chromium forms a passive layer of chromium III oxide ($Cr_2O_3$) when exposed to oxygen. To have their optimum corrosion resistance, stainless steel surfaces must be clean and have an adequate supply of oxygen to maintain this passive surface layer.

Cleaning of stainless steel includes the removal of various surface contaminants to ensure corrosion resistance, to prevent contamination, and to achieve the desired appearance of the steel. Acid cleaning is a process by which a solution of a mineral and/or organic acid in water sometimes in combination with a wetting agent or detergent or both, is employed to remove iron and other metallic contamination, light oxide films, soil and similar contaminants.

Acid cleaning compositions for removing contaminants from stainless steel generally have the mineral or organic acid in a solution with a pH of less than 7.0. The compositions can remove both organic and inorganic soils in the same operation. They also are used to improve corrosion resistance and enhance brightness or gloss of the base metal surface.

One of the problems which arise in the use of steel is its corrosion, either by the atmosphere or by the environment in which it is used. The rate of corrosion may vary, depending on the surrounding conditions and also the composition of the steel. Stainless steel, especially, is much more resistant to corrosion as compared to carbon steels and other steels. The corrosion resistance of stainless steel is due to the addition of chromium and other metals to this alloy. Although stainless steel has appreciable resistance to corrosion, it will still corrode in certain circumstances and attempts have been made to prevent or reduce this corrosion. Most acid cleaners also include a corrosion inhibitor of some sort. For example, in acid media copper sulfate has been used as a corrosion inhibitor. However this and other proposed inhibitors are not entirely satisfactory since, like copper sulfate, they may be expensive, introduce an effluent disposal problem and, moreover, are not entirely effective. For example, when copper containing urea sulfuric solutions are placed in contact with nickel metal, copper will plate the nickel surface.

A variety of compounds, including dialkylthioureas, such as diethylthiourea and dibutylthiourea, are known to reduce the corrosivity of sulfuric acid to carbon steels. Thioureas are not appropriate for food and beverage situations as some of them have been found to pose potential health risks and any remnant thioureas compounds are considered contamination for such surfaces.

The type of acid used has also presented problems in development of acid cleaners. Many acid cleaners are based upon phosphoric acid due to its diverse functionality such as a low corrosion profile on many alloys and elastomers, good mineral solubility and good soil suspension properties. Many acid cleaners are also based on high levels of nitric acid due to its compatibility with a variety of materials as well as its effectiveness at mineral soil solubility and removal. However, high nitric acid based cleaners can cause vapor staining and corrosion to stainless steel due to the volatile airborne nitrogen oxides.

Phosphoric acid and nitric acid continue to have more strict effluent regulations due to the phosphorus and nitrate environmental and drinking water issues. It is therefore an object of this invention to provide a phosphorus free and reduced nitric acid based cleaning composition which has equal or superior cleaning, corrosion and vapor stain inhibiting properties as other phosphoric and nitric acid based cleaners on some varieties of stainless steel, such as the 300 series.

It is another object of this invention to provide aqueous, sulfuric based acid cleaning compositions which are relatively noncorrosive to stainless steel and which have a reduced cost.

Other objects, aspects and advantages of this invention will be apparent to one skilled in the art in view of the following disclosure, the drawings, and the appended claims.

SUMMARY OF THE INVENTION

In some aspects, the present invention employs the use of nitric acid as a corrosion inhibitor for use in acid cleaning compositions. Applicants have found, surprisingly, that the combination of selected amounts of nitric acid as a corrosion inhibitor in an acid cleaning solution works well and minimizes the corrosive properties of sulfuric or other corrosive acids in the use concentration and in the concentrate on a variety of stainless steel. The invention employs an aqueous solution of a pH of less than 7, which uses an acid as the cleaning component. Any acid used in an acid cleaning composition may be combined with nitric acid according to the invention, such as acetic acid, citric acid, oxalic acid, and sulfuric acid, all of which are traditionally used in acid cleaning compositions. In some embodiments, the acid is sulfuric acid. The acid cleaning compositions of the invention retain the anti-corrosive properties of phosphoric acid as well as the cleaning capabilities and can often be less expensive to produce.

Typical sulfuric acid cleaners contain from about 1 to about 30 weight percent, or about 5 to about 25 weight percent sulfuric acid; and about 1 to about 80 weight percent water.

In some aspects, the concentrated cleaning compositions include at least about 5 to about 50 weight percent, or about 5 to about 15 weight percent nitric acid. The weight ratio of nitric acid to sulfuric acid is in the range of about 0.14 to about 10.0 or higher, or at about 0.4 to about 10.0. Compositions with a weight ratio of less than 0.14 nitric acid to sulfuric acid were found to not significantly inhibit corrosion on some stainless steel. There is really no upper limit on the amount of nitric acid that can be added to the solution, so long as the desired corrosion inhibition is achieved with the acid cleaner. However, an increased level of nitric acid can increase the vapor corrosion potential of a particular acid cleaner and can be more destructive to elastomeric components such as gaskets and plastic materials of construction. Not only does the nitric acid protect the surface of the metal from the sulfuric acid, it makes the composition less expensive and retains the low corrosivity and cleaning properties similar to that of phosphoric containing acid based cleaners. Applicants have found that addition of the corrosion inhibitor nitric acid at selected amounts works surprisingly well in acidic cleaning compositions.

According to embodiments of the invention it was found that the corrosion exhibited in stainless steel 316 and 304, the most common types used for food and beverage processing equipment, in contact with exemplary concentrated compositions of the invention resulted in a corrosion rate based on weight loss measurements using MPY (mils per year) of 99.97% lower than that of sulfuric acid alone after a time duration of 335.8 hours at about 122 degrees Farhenheit. The corrosion test results indicated negligible levels of staining and corrosion. Further it was found that the corrosion exhibited in stainless steel 304 after contact with an exemplary use solution composition of the present invention resulted in a 37.5% reduction in corrosion rate based on MPY in comparison to a sulfuric acid solution alone after a time duration of 235.5 hours at about 180 degrees Fahrenheit. Additionally, it was found that the corrosion exhibited in stainless steel 410 after contact with an exemplary use composition of the present invention resulted in a 17.5% reduction in corrosion rate based on MPY in comparison to a sulfuric acid solution alone after a time duration of 65 hours at about 160 degrees Fahrenheit. Lastly, it was found that the corrosion exhibited in 410 stainless steel after contact with an exemplary use composition of the present invention resulted in a 50.5% reduction in corrosion rate based on MPY in comparison to a sulfuric acid solution alone after a time duration of 65 hours at about 180 degrees Fahrenheit.

In some embodiments, the compositions of this invention can be produced by first mixing water and nitric acid, by either batch or continuous processes, to which the sulfuric acid is later added. While not wishing to be bound by any theory, it is postulated that the nitric acid maintains the passivity of the stainless steel by promoting and retaining the passive chromium oxide surface thereby minimizing the formation of acid soluble corrosion products.

While multiple embodiments are disclosed, still other embodiments of the present invention will become apparent to those skilled in the art from the following detailed description, which shows and describes illustrative embodiments of the invention. Accordingly, the detailed description is to be regarded as illustrative in nature and not restrictive.

DETAILED DESCRIPTION OF THE PREFERRED EMBODIMENTS

Figure 1:
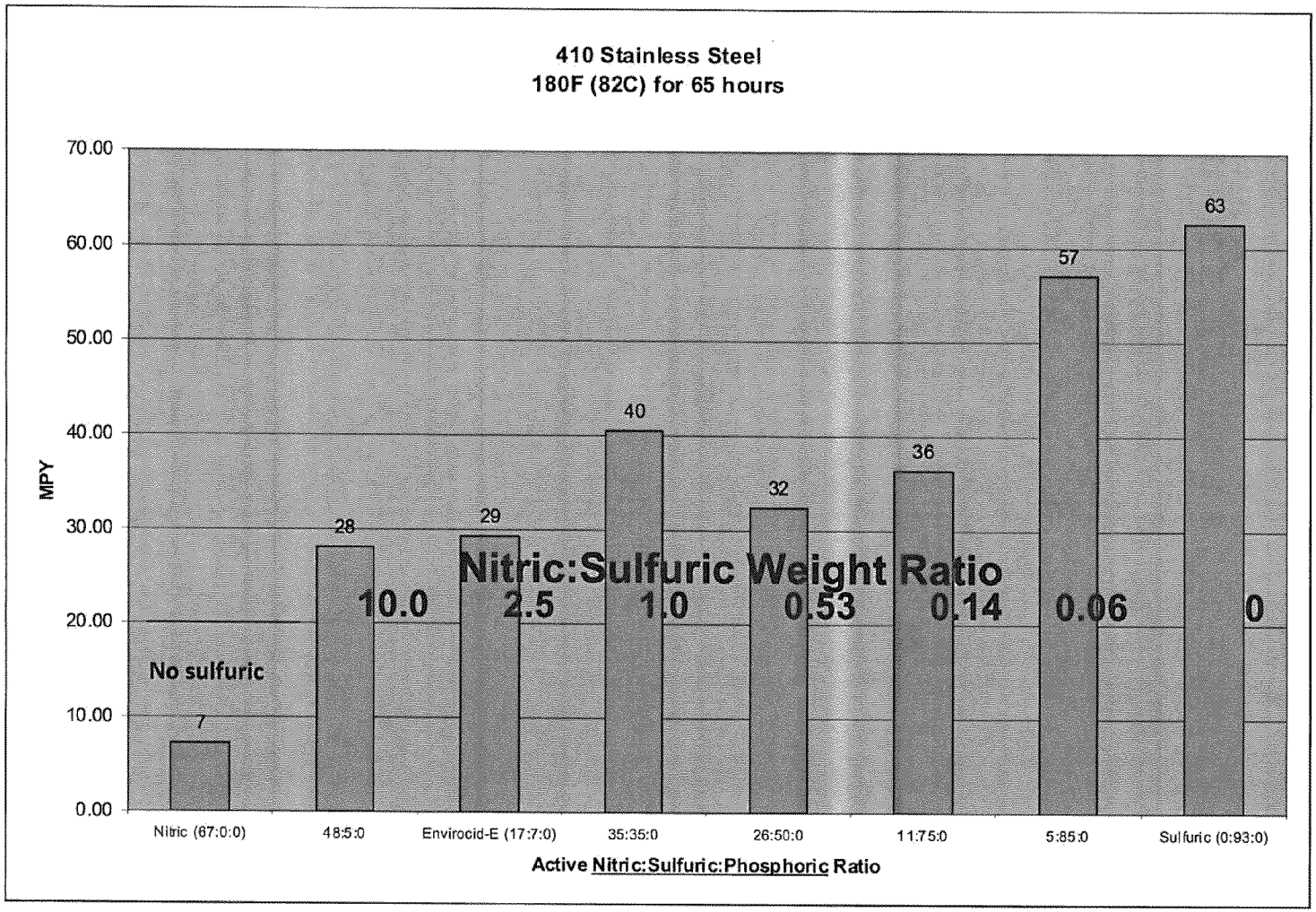
FIG. 1 is a graphical depiction of the corrosion rate of 410 stainless steel coupons after exposure to compositions with differing weight ratios of nitric acid to sulfuric acid to phosphoric acid at 180 degrees Fahrenheit for 65 hours.

So that the invention may be more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt. %. More preferably, the amount of phosphorus is less than 0.1 wt-%, and most preferably the amount of phosphorus is les than 0.01 wt. %.

"Cleaning" means to perform or aid in soil removal, bleaching, microbial population reduction, rinsing, or combination thereof.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g. 1 to 5 includes 1, 1.5, 2, 2.75, 3, 3.80, 4, and 5).

In some aspects, the present disclosure relates to a phosphorus free acid cleaning composition which may be used in place of traditional phosphoric acid cleaning compositions, which retains the cleaning and minimal corrosive properties of the same, which is more environmentally sustainable due to the elimination of phosphorus as well as reduced nitric acid and is less expensive to produce. The composition will find use in most cleaning situations where phosphoric and/or nitric acid containing cleaners can be used for cleaning, including, but not limited to, stainless steel.

Stainless steels are generally classified as carbon steels containing at least about 5 weight percent, usually about 5 to about 40 weight percent, and normally about 10 to about 25 weight percent chromium. They may also contain other alloying elements such as nickel, cerium, aluminum, titanium, copper, or other elements.

Stainless steels are usually classified in three different categories—austenitic, ferritic, and martensitic steels—which have in common the fact that they contain significant amounts of chromium and resist corrosion and oxidation to a great extent than do ordinary carbon steels and most alloy steels.

Austenitic stainless steels or 300 series, make up about 70% of stainless steel production and are the most common alloys of this group. They contain a maximum of 0.25% carbon, a minimum of 16% chromium and sufficient nickel and manganese to retain an austenitic structure at all temperatures from the cryogenic region to the melting point of the alloy. A typical composition of 18% chromium and 10% nickel, commonly known as 18/10 stainless, is often used in flatware. AISI types 302, 303, 304, and 316 are several of the more extensively used austenitic stainless steels.

Ferritic stainless steels are highly corrosion-resistant, but less durable than austenitic grades. They are generally characterized, in part, by the fact that they contain chromium only (in addition to the other components of carbon steel) or only very minor amounts of alloying elements. Martensitic stainless steels are not as corrosion-resistance as the other two classes but are extremely strong and tough, as well as highly machineable, and can be hardened by heat treatment. Martensitic stainless steel contains chromium (about 12-14%), molybdenum (about 0.2-1%), nickel (about 0-2%), and carbon (about 0.1-1%) (giving it more hardness but making the material a bit more brittle). It is quenched and magnetic.

Stainless Steel Grades

The SAE steel grades are the most commonly used grading system in the US for stainless steel.

300 Series—Austenitic Chromium-nickel Alloys

Type 301—highly ductile, for formed products. Also hardens rapidly during mechanical working. Good weldability. Better wear resistance and fatigue strength than 304

Type 302—same corrosion resistance as 304, with slightly higher strength due to additional carbon Type 303—free machining version of 304 via addition of sulfur and phosphorus Type 304—the most common grade; the classic 18/8 stainless steel Type 304L—same as the 304 grade but contains less carbon to increase weldability and is slightly weaker than 304.

Type 304LN—same as 304L, but also nitrogen is added to obtain a much higher yield and tensile strength than 304L Type 308—used as the filler metal when welding 304

Type 309—better temperature resistance than 304, also sometimes used as filler metal when welding dissimilar steels, along with inconel Type 316—the second most common grade (after 304); for food and surgical stainless steel uses; alloy addition of molybdenum prevents specific forms of corrosion. It is also knows as marine grade stainless steel due to its increased resistance to chloride corrosion compared to type 304. 316 is often used for building nuclear reprocessing plants.

Type 316L—extra low carbon grade of 316, generally used in stainless steel watches and marine applications due to its high resistance to corrosion. Also referred to as "A4" in accordance with ISO 3506.

Type 316 Ti—includes titanium for heat resistance, therefore it is used in flexible chimney liners.

Type 321—similar to 304 but lower risk of weld decay due to addition of titanium. See also 347 with addition of niobium for desensitization during welding.

400 Series—ferritic and martensitic chromium alloys

Type 405—ferritic for welding applications

Type 408—heat resistant; poor corrosion resistance; 11% chromium, 8% nickel

Type 409—cheapest type; used for automobile exhausts; ferritic (iron/chromium only).

Type 410—martensitic (high strength iron/chromium). Wear resistant, but less corrosion-resistant.

Type 416—easy to machine due to additional sulfur

Type 420—Cutlery Grade martensitic; similar to the Brearley's original rustless steel. Excellent polishability.

Type 430—decorative, e.g., for automotive trim, ferritic. Good formability, but with reduced temperature and corrosion resistance.

Type 439—ferritic grade, a higher grade version of 409 used for catalytic converter exhaust sections. Increased chromium for improved high temperature corrosion/oxidation resistance.

Type 440—a higher grade of cutlery steel, with more carbon, allowing for much better edge retention when properly heat-treated Type 446—for elevated temperature service The acid cleaning compositions of the invention can be used in, including but not limited to the austenitic stainless steel surfaces mentioned above. The absence of thiol compounds makes the exemplary cleaning compositions acceptable for ware washing and cleaning of other surfaces that come into contact with food.

Clean in Place Procedures

In some aspects, the exemplary compositions of the invention will also find use in removing mineral soils. For example, the composition may be used on stainless steel pipes which need to use acid cleaners to de-lime surfaces including clean in place (i.e., CIP) applications where the cleaner is passed through the pipes without dissembling equipment.

Exemplary industries in which the methods of the present invention can be applied include, but are not limited to: the food and beverage industry, e.g., the dairy, cheese, sugar, and brewery industries; oil processing industry; industrial agriculture and ethanol processing; and the pharmaceutical manufacturing industry.

In some aspects, the methods of the present invention apply to equipment, e.g., industrial equipment, generally cleaned using clean in place cleaning procedures. Examples of such equipment include evaporators, heat exchangers (including tube-in-tube exchangers, direct steam injection, and plate-in-frame exchangers), heating coils (including steam, flame or heat transfer fluid heated) re-crystallizers, pan crystallizers, spray dryers, drum dryers, membranes and tanks.

Conventional CIP (clean-in-place) processes are generally well known. The process includes applying or circulating a water diluted solution of cleaning concentrate (typically about 0.5-3% by volume) onto the surface to be cleaned. The solution flows across the surface (3 to 6 feet/second) to remove the soil. Either new solution is re-applied to the surface, or the same solution is re-circulated and re-applied to the surface as required to achieve a clean soil-free surface.

A typical CIP process to remove a soil (including organic, inorganic or a mixture of the two components) often includes at least three steps: an initial water rinse or previously used chemical rinse, an alkaline and/or acid solution wash, and a final fresh water rinse. Additional steps may include a separate acid or alkaline wash as wall as a separate sanitizing step. The alkaline solution softens the soils and removes the organic alkaline soluble soils. The acid solution removes any remaining mineral soils. The strength of the alkaline and acid solutions, the duration of the cleaning steps and the cleaning solution temperature are typically dependent on the amount and tenacity of the soil. The water rinse removes any residual chemical solution and soils prior to the equipment being returned on-line for production purposes.

Nitric Acid

Nitric acid is an inorganic acid formed by catalytically oxidizing ammonia with air to form nitrogen dioxide. When the nitrogen dioxide is dissolved in water, 60% nitric acid is formed.

$$3NO_2+H_2O \rightarrow 2HNO_3+NO$$

It has the condensed structural formula $HNO_3$, and the chemical structure is illustrated below.

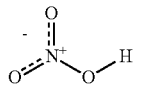

According to aspects of the invention, nitric acid is added as a corrosion inhibitor to acid cleaning compositions. Applicants have found that the addition of nitric acid at certain weight ratios to sulfuric acid and other acids in an aqueous acid cleaning composition works surprisingly well at inhibiting corrosion of stainless steel in the presence of sulfuric acid and other acids to almost negligible corrosion levels.

In some embodiments, the present invention employs the use of nitric acid at a selected weight ratio as a corrosion inhibitor for use in acid cleaning compositions that include sulfuric acid. Typical sulfuric acid cleaners contain from about 1 to about 30, or about 15 to about 25 weight percent sulfuric acid and about 1 to 80 weight percent water in the concentrated acid product.

In some embodiments, nitric acid is included in the compositions at an amount of at least about 5 to about 50 weight percent, or about 5 to about 15 weight percent. The weight ratio of nitric acid to sulfuric acid is in the range of about 0.14 to about 10.0 or higher, or at about 0.4 to about 10.0. Compositions with a weight ratio less than 0.14 nitric acid to sulfuric acid were found to not significantly inhibit corrosion on some stainless steel. There is really no upper limit on the amount of nitric acid that can be added to the solution, so long as the desired corrosion inhibition is achieved with the acid cleaner. However, an increased level of nitric acid can increase the vapor corrosion potential of a particular acid cleaner. Not only does the nitric acid protect the surface of the metal from the sulfuric acid, it makes the composition less expensive and retains the low corrosivity and cleaning properties similar to that of phosphoric containing acid based cleaners. Applicants have found that addition of the corrosion inhibitor nitric acid at the proper weight ratio works surprisingly well in acidic cleaning compositions.

In some embodiments, it was found that the corrosion exhibited in stainless steel 316 and 304, the most common types used in food and beverage processing equipment, in contact with an exemplary concentrated composition of the invention resulted in a 99.97% lower corrosion rate, based on weight loss measurements using MPY (mils per year), than that of sulfuric acid alone after a time duration of 335.8 hours at about 122 degrees Farhenheit. The corrosion test results indicated negligible levels of staining and corrosion. Further it was found that the corrosion exhibited in stainless steel 304 after contact with an exemplary use solution composition of the present invention resulted in a 37.5% reduction in corrosion rate based on MPY in comparison to a sulfuric acid solution alone after a time duration of 235.5 hours at about 180 degrees Fahrenheit. Additionally, it was found that the corrosion exhibited in stainless steel 410 after contact with an exemplary use composition of the present invention resulted in a 17.5% reduction in corrosion rate based on MPY in comparison to a sulfuric acid solution alone after a time duration of 65 hours at about 160 degrees Fahrenheit. Lastly, it was found that the corrosion exhibited in 410 stainless steel after contact with an exemplary use composition of the present invention resulted in a 50.5% reduction in corrosion rate based on MPY in comparison to a sulfuric acid solution alone after a time duration of 65 hours at about 180 degrees Fahrenheit.

In some embodiments, the compositions can be produced by first mixing water and nitric acid, by either batch or continuous processes, to which the sulfuric acid is later added.

While not wishing to be bound by any theory, it is postulated that the nitric acid maintains the passivity of the stainless steel by promoting and retaining the passive chromium oxide surface thereby minimizing the formation of acid soluble corrosion products.

Additives

The aqueous solutions according to the invention may also contain other components, if this appears to be desirable. In many cases it is advisable to add surfactants in order to encourage a simultaneous cleaning and degreasing effect, and to ensure satisfactory wetting of the surfaces being treated with the acid cleaning composition. The desired amount of the surfactants may be added directly to the treatment solution, but it is preferable to add them to the concentrate used in producing the solution.

In addition to the main components other additives may be added to the compositions depending upon the soils to be removed, the stainless steel or other material to be cleaned, the requiring inhibiting affects, the desired final surface properties and the waste disposal requirements and economic considerations. Other additives may also be included including but not limited to wetting agents to lower solution surface tension, solvents to aid in the removal of hydrophobic soils, defoamers to prevent foam or foam buildup on solution surface, thickeners (acid stable) to allow the cleaner to adhere (cling to vertical surface), passivators to protect the surface from environmental attack, and biocides to control odor problems and kill harmful bacteria. Dyes and other components may also be added.

The term "surfactant" or "surface active agent" refers to an organic chemical that when added to a liquid changes the properties of that liquid at a surface.

Aesthetic enhancing agents such as colorants and perfume are also optionally incorporated into the concentrate composition of the invention. Examples of colorants useful in the present invention include but are not limited to liquid and powdered dyes from Milliken Chemical, Keystone, Clariant, Spectracolors, and Pylam.

Examples of perfumes or fragrances useful in concentrate compositions of the invention include but are not limited to liquid fragrances from J&E Sozio, Firmenich, and IFF (International Flavors and Fragrances).

It should be understood that the water provided as part of the solution or concentrate can be relatively free of hardness. It is expected that the water can be deionized to remove a majority of the dissolved solids in the water. The concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Examples of useful ranges for the basic composition for the acid cleaning composition of the invention include those provided in Table 1 illustrated below:

TABLE 1

| Component | Weight Percent | Preferable Weight Percent |
|---|---|---|
| Sulfuric Acid | 1-30 | 15-25 |
| Nitric Acid | 5-50 | 5-15 |
| Water | 1-80 | 1-60 |
| Dye | Up to 1 | Up to 1 |
| Urea | Up to 5 | Up to 5 |
| Surfactant | Up to 5 | Up to 5 |

The composition range listed above results in a nitric to sulfuric acid active weight ratio of about 0.2 to 1.0.

The sulfuric/nitric acid compositions of this invention can be produced by the mixture of nitric acid and water by either batch or continuous process with the addition of sulfuric acid and any other excipients.

Use of acid cleaners may also include the application of an alkaline detergent cleaning product and water rinse to the surface to be cleaned. The alkaline detergent may be applied either prior to or after application of the acid cleaner. Application of the acid cleaner may or may not be followed by a subsequent water rinse.

The invention has been shown and described herein in what is considered to be the most practical and preferred embodiments. The applicant recognizes, however, that departures may be made therefrom within the scope of the invention and that modifications will occur to a person skilled in the art. The examples which follow are intended for purposes of illustration only and are not intended to limit the scope of the invention. All references cited herein are hereby incorporated in their entirety by reference.

EXAMPLES

The effect of various compositions on the corrosion rate of stainless steel as measured in MPY was evaluated. The compositions tested included varying weight ratios of nitric acid to sulfuric acid to phosphoric acid. For this evaluation, clean, passivated stainless steel coupons were obtained. The coupons were weighed prior to the corrosion tests. The coupons were then submerged in the selected test composition for a specified period of time. At the end of the desired time, the coupons were rinsed, dried and re-weighed. To calculate the MPY the following equation was used:

$$MPY=(534568\times\text{grams weight loss})/(\text{inches}^2\text{ average surface area}\times\text{hours time}\times\text{grams/centimeters}^3\text{ metal alloy density})$$

For the first study, 410 SS coupons were exposed to compositions with varying nitric acid/sulfuric acid/phosphoric acid ratios at 180° F. for 65 hours. The results of this study are shown in FIG. 1. As can be seen in this figure, the corrosion rates on the 410 SS coupons increased as the sulfuric acid/nitric acid weight ratio and/or mole ratio increased. As can also be seen in this figure, a weight ratio of nitric acid to sulfuric acid of 0.14 or higher resulted in at least a 58% reduction in corrosion rate (based upon mils per year) as compared to straight sulfuric acid.

Figure 2:
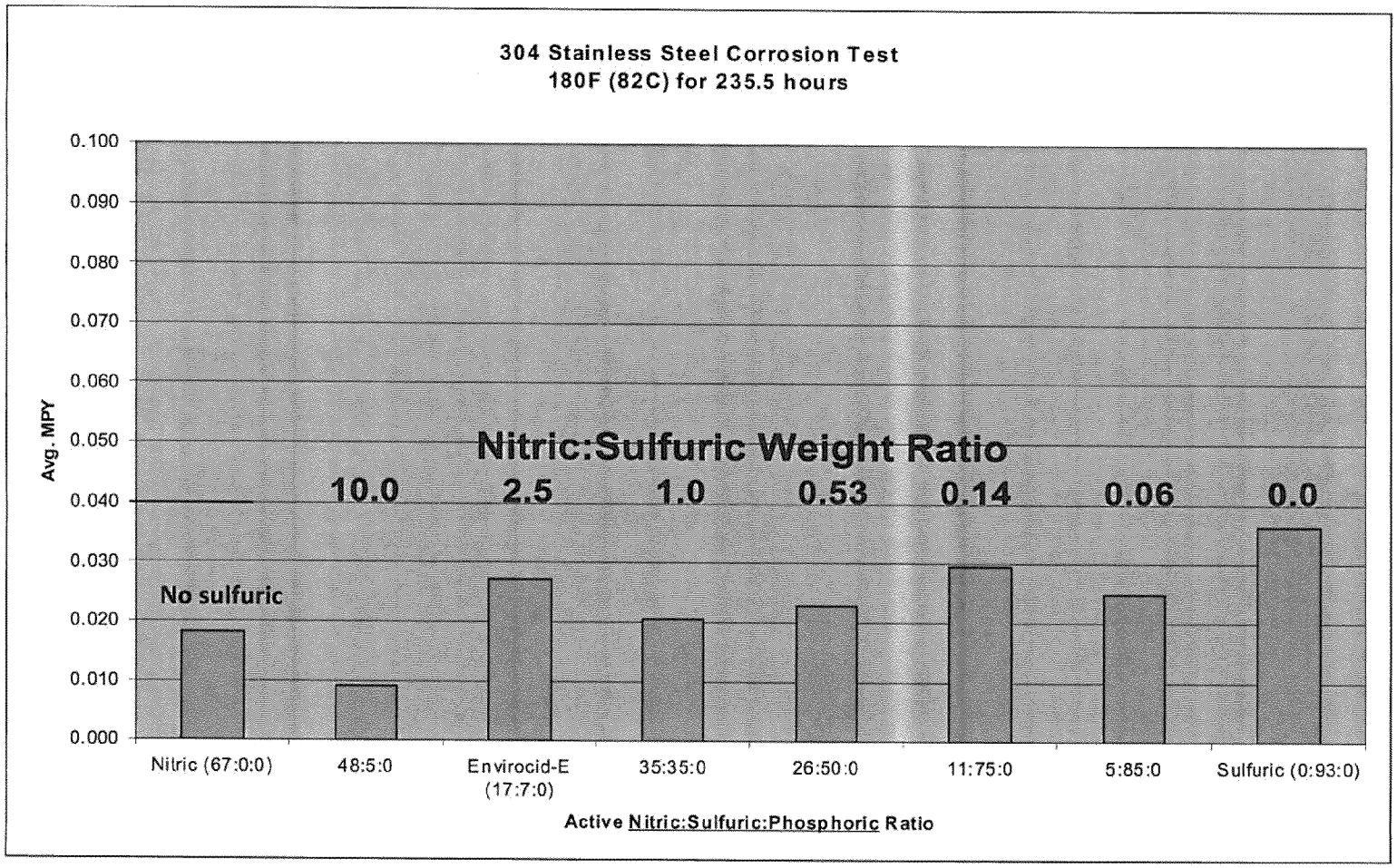
FIG. 2 is a graphical depiction of the corrosion rate of 304 stainless steel coupons after exposure to compositions with differing weight ratios of nitric acid to sulfuric acid to phosphoric acid at 180 degrees Fahrenheit for 235.5 hours.

For the second study, 304 SS coupons were exposed to compositions with varying nitric acid/sulfuric acid/phosphoric acid ratios at 180° F. for 235.5 hours. The results of this study are shown in FIG. 2. As can be seen in this figure, the corrosion rates were very low for all formulas tested, resulting in less than 0.04 MPY. Compared to the previous study, the results on 304 SS indicated a slight increase in the corrosion rate when higher amounts of sulfuric acid were included. As can also be seen in this figure, a weight ratio of nitric acid to sulfuric acid of 0.14 or higher resulted in at least a 19% reduction in corrosion rate as compared to straight sulfuric acid on 304 stainless steel at use concentrations equivalent to about 0.8% acidity calculated as nitric acid, at 180 F and 235.5 hours of soak time.

Figure 3:
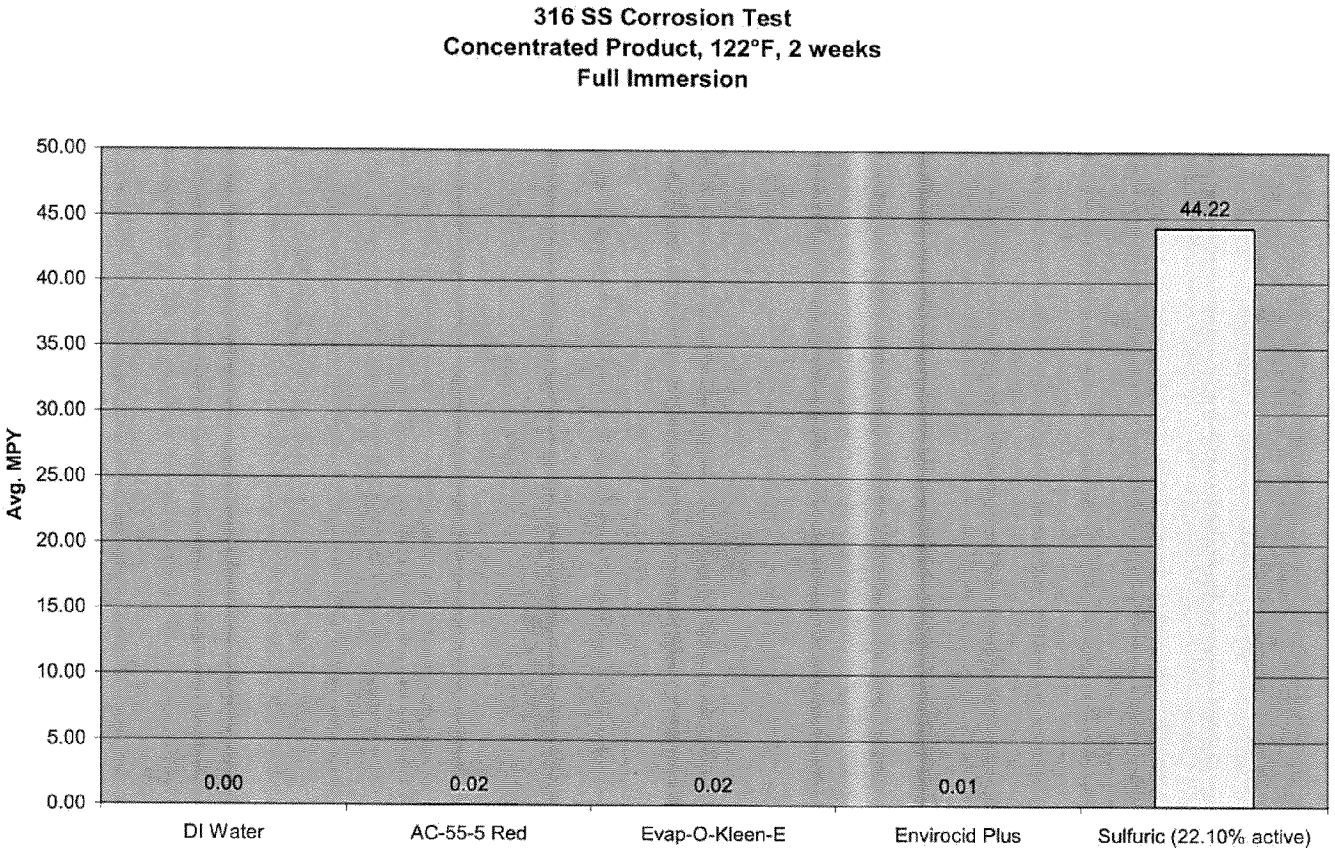
FIG. 3 is a graphical depiction of the corrosion rate of 316 stainless steel coupons immersed in five different test compositions at 122 degrees Fahrenheit for two weeks.

In a third study, 316 stainless steel coupons were immersed in five different test compositions at 122 degrees Fahrenheit for two weeks. The concentrated compositions included the following: 1) deionized water only; 2) AC-55-5, a commercially available product which includes a blend of nitric and phosphoric acid, and does not contain sulfuric acid; 3) Evap-O-Kleen-E, a commercially available product which includes a blend of nitric, phosphoric and sulfuric acid, with a nitric acid to sulfuric acid weight ratio of 6.13; 4) an exemplary composition of the invention which is a blend of nitric and sulfuric acid, and has a nitric acid to sulfuric acid weight ratio of 0.52 and, 5) sulfuric acid only. The results from this study are shown in FIG. 3. As can be seen in FIG. 3, the exemplary solution of this invention demonstrated a very low corrosion rate (based upon mil per year) and specifically demonstrated a much lower corrosion rate in comparison to sulfuric acid alone without the use of phosphoric acid as a corrosion inhibitor. As can also be seen in FIG. 3, the composition in accordance with embodiments of the present invention that included the desired weight ratio of nitric to sulfuric acid resulted in an acid composition that was significantly less corrosive than sulfuric acid alone.

Many modifications and variations of the invention as hereinbefore set forth can be made without departing from the spirit and scope thereof, and, therefore, only such limitations should be imposed as are indicated by the appended claims.

What is claimed is:

1. A method of cleaning soils from industrial equipment and inhibiting corrosion, the method comprising:

(a) applying an aqueous corrosion inhibited acid cleaning composition to the soil, the composition comprising an aqueous sulfuric acid cleaning solution having less than 4 weight percent urea in contact with a stainless steel surface and an aqueous corrosion inhibitor at a composition temperature up to about 190 degrees Fahrenheit.

2. The method according to claim 1, wherein the aqueous corrosion inhibited acid cleaning composition comprises about 1 to about 30 wt. % sulfuric acid.

3. The method according to claim 1, wherein the aqueous corrosion inhibited acid cleaning composition comprises about 5 wt. % to about 50 wt. % corrosion inhibitor.

4. The method of claim 3, wherein the corrosion inhibitor is nitric acid.

5. The method of claim 1, wherein the aqueous corrosion inhibited acid cleaning composition comprises about 1 wt. % to about 80 wt. % water.

6. The method of claim 1, wherein the composition is in a concentrated form that may be diluted to a usable cleaning solution concentration.

7. The method of claim 1, wherein the aqueous corrosion inhibited acid cleaning composition comprises about 0.01 wt. % to about 5 wt. % surfactant.

8. The method of claim 7, wherein the surfactant is a non-ionic surfactant, cationic surfactant or mixtures thereof.

9. The method of claim 1, wherein the aqueous corrosion inhibited acid cleaning composition is substantially free of a metallic ion, a phosphorus compound or an amine.

10. The method of claim 1, wherein the weight ratio of aqueous corrosion inhibitor to aqueous sulfuric acid is in the range of about 0.14 to about 10.0.

11. The method of claim 10, wherein the weight ratio of nitric acid to sulfuric acid is in the range of about 0.14 to about 10.0.

12. The method of claim 1, wherein the mole ratio of aqueous corrosion inhibitor to aqueous sulfuric acid cleaning solution is in the range of about 0.22 to about 15.0.

13. The method of claim 12, wherein the mole ratio of nitric acid to sulfuric acid is in the range of about 0.22 to about 15.0.

14. An aqueous corrosion inhibited acid cleaning composition for inhibiting corrosion, the composition comprising:

(a) about 1 to about 30 wt. % aqueous sulfuric acid cleaning solution;

(b) about 5 to about 50 wt. % nitric acid;

(c) about 1 wt. % to about 80 wt. % water; and, (d) up to about 5 weight % urea;

wherein the weight ratio of aqueous nitric acid cleaning solution to sulfuric acid is in the range of about 0.14 to about 10.0.

15. The composition of claim 14, wherein the composition is in a concentrated form that may be diluted to a usable cleaning solution concentration.

16. The composition of claim 14, wherein the composition further comprises about 0.01 wt. % to about 5 wt. % surfactant.

17. The composition of claim 16, wherein the surfactant is a non-ionic surfactant, cationic surfactant or mixtures thereof.

18. The composition of claim 14, wherein the aqueous corrosion inhibited acid cleaning composition is substantially free of a metallic ion, a phosphorus compound or an amine.

19. The composition of claim 14, wherein the weight ratio of aqueous nitric acid cleaning solution to sulfuric acid is in the range of about 0.4 to about 10.0.

20. The composition of claim 14, wherein the mole ratio of aqueous nitric acid cleaning solution to sulfuric acid is in the range of about 0.22 to about 15.0.

21. A method of cleaning soils from industrial equipment in a clean in place process with the aqueous corrosion inhibited acid cleaning composition of claim 14.

22. The composition of claim 14, wherein the composition is in contact with stainless steel at a temperature range up to approximately 200 degrees Fahrenheit.

* * * * *